US008201298B2

(12) United States Patent
Hohlbein

(10) Patent No.: US 8,201,298 B2
(45) Date of Patent: Jun. 19, 2012

(54) TOOTHBRUSH WITH LOW PROFILE HEAD

(75) Inventor: Douglas J. Hohlbein, Pennington, NJ (US)

(73) Assignee: Colgate-Palmolive Company, New York, NY (US)

( * ) Notice: Subject to any disclaimer, the term of this patent is extended or adjusted under 35 U.S.C. 154(b) by 1234 days.

(21) Appl. No.: 11/672,991

(22) Filed: Feb. 9, 2007

(65) Prior Publication Data

US 2008/0189888 A1 Aug. 14, 2008

(51) Int. Cl.
*A46B 9/04* (2006.01)
*A61B 17/24* (2006.01)

(52) U.S. Cl. ..... 15/110; 15/111; 15/167.1; 15/188

(58) Field of Classification Search ..... 15/111, 15/110, 167.1, DIG. 5, 188
See application file for complete search history.

(56) References Cited

U.S. PATENT DOCUMENTS

| | | | |
|---|---|---|---|
| 585,358 | A | 6/1897 | Gould |
| 697,338 | A | 4/1902 | Hagerty |
| 726,727 | A | 4/1903 | Mills |
| 864,054 | A | 8/1907 | Abrams |
| 907,842 | A | 12/1908 | Meuzles |
| 1,002,468 | A | 9/1911 | Strangman |
| 1,006,630 | A | 10/1911 | Clarke |
| 1,125,532 | A | 1/1915 | Himmel |
| 1,128,139 | A | 2/1915 | Hoffman |
| 1,142,698 | A | 6/1915 | Crumbaugh |
| 1,153,409 | A | 9/1915 | Wheeler |
| 1,251,250 | A | 12/1917 | Libby |
| 1,268,544 | A | 6/1918 | Cates |
| 1,191,556 | A | 7/1918 | Blake |
| 1,470,710 | A | 10/1923 | Davis |
| 1,495,675 | A | 5/1924 | Colt |
| 1,598,224 | A | 8/1926 | Van Sant |
| 1,658,706 | A | 2/1928 | Carrott |
| D75,971 | S | 8/1928 | Faubert et al. |
| 1,704,564 | A | 3/1929 | Friedland |
| 1,705,109 | A | 3/1929 | Essbach |
| 1,728,958 | A | 9/1929 | Darmitzel |
| 1,741,143 | A | 12/1929 | Chln |
| 1,816,582 | A | 7/1931 | Haron |
| 1,817,585 | A | 8/1931 | Samuel |
| 1,833,555 | A | 11/1931 | Bell et al. |

(Continued)

FOREIGN PATENT DOCUMENTS

| | | |
|---|---|---|
| CH | 99738 | 6/1923 |

(Continued)

OTHER PUBLICATIONS

International Search Report Dated (Sep. 22, 2008).

(Continued)

*Primary Examiner* — Randall Chin
(74) *Attorney, Agent, or Firm* — Amy M. Fernandez

(57) ABSTRACT

A toothbrush includes a handle, and a head at an end of the handle having a thickness, a first surface, and an opposed second surface. Tooth cleaning elements extend outwardly from the first surface and have a length. A tissue cleanser is positioned on the second surface and has a plurality of tissue engaging elements and a height. A head height includes the thickness of the head, the length of the tooth cleaning elements, and the height of the tissue cleanser, and is less than 17.7 mm.

10 Claims, 3 Drawing Sheets

U.S. PATENT DOCUMENTS

| | | | | |
|---|---|---|---|---|
| 1,860,924 | A | | 5/1932 | Cooke |
| 1,861,347 | A | | 5/1932 | Johnson |
| 1,872,832 | A | | 8/1932 | Silverberg |
| 1,891,884 | A | | 12/1932 | Barrett |
| 1,892,088 | A | | 12/1932 | Metzler |
| 1,903,181 | A | | 3/1933 | Barkan |
| 2,083,217 | A | | 7/1934 | Brothers et al. |
| 1,993,753 | A | | 3/1935 | Touchstone |
| 1,993,862 | A | | 3/1935 | Green |
| 2,042,239 | A | | 5/1936 | Planding |
| 2,049,958 | A | | 8/1936 | Greenberg |
| 2,079,728 | A | | 5/1937 | Arnold |
| D99,352 | S | | 4/1938 | Grapp |
| 2,129,082 | A | | 9/1938 | Byrer |
| 2,059,914 | A | | 11/1938 | Rosenberg |
| 2,151,349 | A | | 6/1939 | Madden |
| 2,188,005 | A | | 1/1940 | Casio |
| 2,196,284 | A | | 4/1940 | Ackerman |
| D122,815 | S | | 10/1940 | Crosby |
| 2,218,072 | A | | 10/1940 | Runnels |
| 2,225,331 | A | | 12/1940 | Campbell |
| 2,233,938 | A | | 3/1941 | Campbell |
| 2,253,210 | A | | 8/1941 | Psiharls |
| 2,253,910 | A | | 8/1941 | Luenz |
| 2,263,602 | A | | 11/1941 | Grusin |
| 2,305,461 | A | | 12/1942 | Spyra |
| 2,364,205 | A | | 12/1944 | Fuller |
| 2,418,486 | A | | 4/1947 | Shipley |
| 2,405,029 | A | | 7/1948 | Gallarty et al. |
| 2,491,274 | A | | 12/1948 | McNail |
| 2,512,059 | A | | 6/1950 | Haeusser |
| 2,651,088 | A | | 11/1950 | Sako |
| 2,543,999 | A | | 3/1951 | Voss |
| D162,941 | S | | 4/1951 | Ehman |
| 2,554,777 | A | | 5/1951 | Dangin |
| 2,574,854 | A | | 11/1951 | Moore |
| 2,583,750 | A | | 1/1952 | Runnels |
| 2,642,604 | A | | 6/1953 | Ferrari |
| 2,708,762 | A | | 6/1953 | King et al. |
| 2,686,325 | A | | 8/1954 | Silver |
| 2,702,914 | A | | 3/1955 | Kittle et al. |
| 3,103,680 | A | | 9/1963 | Krichmar |
| 3,153,800 | A | | 10/1964 | Trotin |
| 3,181,193 | A | | 5/1965 | Nobles et al. |
| 3,195,537 | A | | 7/1965 | Blasi |
| 3,230,562 | A | | 1/1966 | Birch |
| 3,254,356 | A | | 6/1966 | Yao et al. |
| 3,258,805 | A | | 7/1966 | Rossnan |
| 3,337,893 | A | | 8/1967 | Fine et al. |
| D213,669 | S | | 4/1969 | Miller |
| 3,509,874 | A | | 5/1970 | Stillman |
| 3,610,043 | A | | 10/1971 | Wemyss |
| 3,633,237 | A | | 1/1972 | Bagube |
| 4,299,208 | A | | 11/1981 | Blanc |
| 4,328,604 | A | | 5/1982 | Adams |
| 4,356,585 | A | | 11/1982 | Protell et al. |
| 4,364,142 | A | | 12/1982 | Pangle |
| D272,683 | S | | 2/1984 | Stocchi |
| D272,687 | S | | 2/1984 | Stocchi |
| D272,689 | S | | 2/1984 | Stocchi |
| D272,690 | S | | 2/1984 | Stocchi |
| D273,635 | S | | 5/1984 | Stocchi |
| 4,455,704 | A | | 6/1984 | Williams |
| 4,488,327 | A | | 12/1984 | Snider |
| 4,610,043 | A | | 9/1986 | Vezjak |
| D287,072 | S | | 12/1986 | Pfleger |
| 4,628,564 | A | | 12/1986 | Youssef |
| D295,695 | S | | 5/1988 | Golzari |
| 4,827,551 | A | | 5/1989 | Maser et al. |
| 4,888,844 | A | | 12/1989 | Maggs |
| D309,528 | S | | 7/1990 | Valenti |
| 5,005,246 | A | | 4/1991 | Yen-Hui |
| 5,027,796 | A | | 7/1991 | Linzey |
| 5,032,082 | A | | 7/1991 | Herrera |
| 5,040,260 | A | | 8/1991 | Michaels |
| 5,120,225 | A | | 6/1992 | Amit |
| 5,165,761 | A | | 11/1992 | Dirksing |
| 5,176,427 | A | | 1/1993 | Weihrauch |
| 5,226,197 | A | | 7/1993 | Nack et al. |
| 5,230,118 | A | | 7/1993 | Chamma |
| 5,242,235 | A | | 9/1993 | Li |
| 5,249,327 | A | | 10/1993 | Hing |
| 5,273,425 | A | | 12/1993 | Hoagland |
| 5,305,489 | A | | 4/1994 | Lage |
| D350,851 | S | | 9/1994 | Spence, Jr. |
| 5,392,483 | A | | 2/1995 | Heinzelman et al. |
| 5,396,678 | A | | 3/1995 | Bredall et al. |
| 5,438,726 | A | | 8/1995 | Leite |
| 5,445,825 | A | | 8/1995 | Copelan et al. |
| 5,511,273 | A | | 4/1996 | Carroll |
| 5,530,981 | A | | 7/1996 | Chen |
| 5,535,474 | A | | 7/1996 | Salazar |
| 5,564,150 | A | * | 10/1996 | Ciccotelli ..... 15/167.1 |
| 5,570,487 | A | | 11/1996 | Schneider |
| D376,695 | S | | 12/1996 | Tveras |
| 5,584,690 | A | | 12/1996 | Maassarani |
| 5,604,951 | A | | 2/1997 | Shipp |
| 5,613,262 | A | | 3/1997 | Choy-Maldonado |
| 5,628,082 | A | | 5/1997 | Moskovich |
| D386,905 | S | | 12/1997 | Brady et al. |
| 5,709,004 | A | | 1/1998 | Paduano et al. |
| D390,706 | S | | 2/1998 | Hohlbein et al. |
| D391,769 | S | | 3/1998 | Kling et al. |
| 5,735,011 | A | | 4/1998 | Asher |
| 5,735,864 | A | | 4/1998 | Heisinger, Jr. |
| 5,758,380 | A | | 6/1998 | Vrignaud |
| 5,766,193 | A | | 6/1998 | Millner |
| D396,288 | S | | 7/1998 | Samuel |
| 5,778,475 | A | | 7/1998 | Garcia |
| 5,778,476 | A | | 7/1998 | Squillaci et al. |
| 5,779,654 | A | | 7/1998 | Foley et al. |
| D397,219 | S | | 8/1998 | Rangel et al. |
| 5,792,159 | A | | 8/1998 | Amin |
| 5,802,656 | A | | 9/1998 | Dawson et al. |
| 5,810,856 | A | | 9/1998 | Tveras |
| D399,349 | S | | 10/1998 | Barth |
| 5,817,114 | A | | 10/1998 | Anderson et al. |
| 5,818,856 | A | | 10/1998 | Injeyan et al. |
| D401,069 | S | | 11/1998 | Lamond et al. |
| 5,836,769 | A | * | 11/1998 | Spencer ..... 433/216 |
| D402,116 | S | | 12/1998 | Magloff et al. |
| 5,842,247 | A | | 12/1998 | Decesare et al. |
| 5,845,358 | A | | 12/1998 | Woloch |
| D403,510 | S | | 1/1999 | Menke et al. |
| D404,205 | S | | 1/1999 | Hohlbein |
| D404,206 | S | | 1/1999 | Hohlbein |
| D405,272 | S | | 2/1999 | Khalaj et al. |
| D407,221 | S | | 3/1999 | Van Gelder |
| D407,222 | S | | 3/1999 | Van Gelder |
| D407,223 | S | | 3/1999 | Van Gelder |
| 5,875,510 | A | | 3/1999 | Lamond et al. |
| 5,896,614 | A | | 4/1999 | Flewitt |
| 5,913,346 | A | | 6/1999 | Narwani |
| 5,915,433 | A | | 6/1999 | Hybler |
| 5,920,941 | A | | 7/1999 | Iannotta |
| 5,928,254 | A | | 7/1999 | Jensen |
| 5,930,860 | A | | 8/1999 | Shipp |
| 5,938,673 | A | | 8/1999 | DePierro et al. |
| 5,946,759 | A | | 9/1999 | Cann |
| 5,951,578 | A | | 9/1999 | Jensen |
| 5,957,942 | A | | 9/1999 | Yudelman |
| 5,967,152 | A | | 10/1999 | Rimkus |
| 5,970,564 | A | | 10/1999 | Inns et al. |
| 5,980,541 | A | | 11/1999 | Tenzer |
| 5,980,542 | A | | 11/1999 | Saldivar |
| 5,984,935 | A | | 11/1999 | Welt et al. |
| 6,015,293 | A | | 1/2000 | Rimkus |
| D420,515 | S | | 2/2000 | Van Gelder |
| D421,844 | S | | 3/2000 | Stark et al. |
| 6,032,315 | A | | 3/2000 | Liebel |
| 6,041,467 | A | | 3/2000 | Roberts et al. |
| D422,413 | S | | 4/2000 | Goldinger et al. |
| D423,785 | S | | 5/2000 | Karallis |
| D423,786 | S | | 5/2000 | Zelinski |
| D423,787 | S | | 5/2000 | Musciano |
| D424,808 | S | | 5/2000 | Beals et al. |
| D424,809 | S | | 5/2000 | Bernard |

| | | | | |
|---|---|---|---|---|
| D425,306 | S | 5/2000 | Beals et al. | |
| 6,058,541 | A | 5/2000 | Masterman et al. | |
| D428,702 | S | 8/2000 | Van Gelder | |
| 6,098,233 | A | 8/2000 | Chen | |
| 6,105,191 | A | 8/2000 | Chen et al. | |
| 6,108,851 | A | 8/2000 | Bredall et al. | |
| 6,108,869 | A | 8/2000 | Meessmann et al. | |
| 6,119,296 | A | 9/2000 | Noe et al. | |
| 6,131,228 | A | 10/2000 | Chen et al. | |
| D434,906 | S | 12/2000 | Beals et al. | |
| 6,171,323 | B1 | 1/2001 | Potti et al. | |
| D440,767 | S | 4/2001 | Moskovich et al. | |
| 6,250,227 | B1 | 6/2001 | Fulpo | |
| 6,254,390 | B1 | 7/2001 | Wagner | |
| 6,276,021 | B1 | 8/2001 | Hohlbein | |
| 6,289,545 | B1 | 9/2001 | Motster | |
| D448,569 | S | 10/2001 | Harris et al. | |
| 6,322,573 | B1 | 11/2001 | Murayama | |
| 6,345,405 | B1 | 2/2002 | Brackin | |
| 6,352,545 | B1 | 3/2002 | Wagner | |
| 6,353,958 | B2 | 3/2002 | Weihrauch | |
| RE37,625 | E | 4/2002 | Wieder et al. | |
| D456,139 | S | 4/2002 | Hohlbein | |
| 6,374,448 | B2 | 4/2002 | Seifert | |
| D456,607 | S | 5/2002 | Carlucci et al. | |
| 6,383,202 | B1 | 5/2002 | Rosenblood | |
| D459,087 | S | 6/2002 | Pfleger | |
| 6,402,768 | B1 | 6/2002 | Liebel | |
| 6,408,476 | B1 | 6/2002 | Cann | |
| 6,421,867 | B1 | 7/2002 | Weihrauch | |
| D461,959 | S | 8/2002 | Chan et al. | |
| D463,131 | S | 9/2002 | Winter et al. | |
| 6,446,295 | B1 | 9/2002 | Calabrese | |
| D464,796 | S | 10/2002 | Winter et al. | |
| 6,463,619 | B2 | 10/2002 | Gavney, Jr. | |
| D465,847 | S | 11/2002 | Jacobs | |
| 6,496,999 | B1 | 12/2002 | Gleason et al. | |
| 6,513,182 | B1 | 2/2003 | Calabrese et al. | |
| D471,276 | S | 3/2003 | Potti | |
| 6,546,586 | B2 | 4/2003 | Cho | |
| D477,465 | S | 7/2003 | Reilly et al. | |
| D478,211 | S | 8/2003 | Ping | |
| 6,625,839 | B2 | 9/2003 | Fischer | |
| D482,199 | S | 11/2003 | De Salvo | |
| 6,647,581 | B1 | 11/2003 | Persad et al. | |
| D483,184 | S | 12/2003 | Geiberger et al. | |
| D483,568 | S | 12/2003 | Jamson | |
| D486,649 | S | 2/2004 | Sprosta et al. | |
| 6,729,789 | B2 | 5/2004 | Gordon | |
| 6,779,851 | B2 | 8/2004 | Boucherie | |
| 6,817,054 | B2 | 11/2004 | Moskovich et al. | |
| 6,859,969 | B2 | 3/2005 | Gavney et al. | |
| D503,538 | S | 4/2005 | De Salvo | |
| 6,886,207 | B1 | 5/2005 | Solanki | |
| 6,895,629 | B1 | 5/2005 | Wenzler | |
| 7,143,462 | B2 * | 12/2006 | Hohlbein | 15/111 |
| 7,273,327 | B2 * | 9/2007 | Hohlbein et al. | 401/132 |
| 2001/0023516 | A1 | 9/2001 | Driesen et al. | |
| 2001/0041903 | A1 | 11/2001 | Richard | |
| 2001/0042280 | A1 | 11/2001 | Moskovich et al. | |
| 2002/0000964 | A1 | 1/2002 | Sumiya | |
| 2002/0019645 | A1 | 2/2002 | Fischer et al. | |
| 2002/0108194 | A1 | 8/2002 | Carlucci et al. | |
| 2002/0124333 | A1 | 9/2002 | Hafliger et al. | |
| 2002/0124337 | A1 | 9/2002 | Calabrese et al. | |
| 2002/0138926 | A1 | 10/2002 | Brown, Jr. et al. | |
| 2002/0138928 | A1 | 10/2002 | Calabrese | |
| 2003/0009837 | A1 | 1/2003 | Cann | |
| 2003/0115699 | A1 | 6/2003 | Wagstaff | |
| 2003/0116884 | A1 | 6/2003 | Wagstaff | |
| 2003/0163149 | A1 | 8/2003 | Heisinger, Jr. | |
| 2003/0167582 | A1 | 9/2003 | Fischer et al. | |
| 2003/0196283 | A1 | 10/2003 | Eliav et al. | |
| 2003/0208865 | A1 | 11/2003 | Davies | |
| 2003/0216762 | A1 | 11/2003 | Levit | |
| 2003/0229959 | A1 | 12/2003 | Gavney et al. | |
| 2004/0006837 | A1 | 1/2004 | Cann | |
| 2004/0025275 | A1 | 2/2004 | Moskovich et al. | |
| 2004/0068810 | A1 | 4/2004 | Lee | |
| 2004/0087882 | A1 * | 5/2004 | Roberts et al. | 601/141 |
| 2004/0134007 | A1 | 7/2004 | Davies | |
| 2004/0200748 | A1 | 10/2004 | Klassen et al. | |
| 2004/0255416 | A1 | 12/2004 | Hohlbein | |
| 2005/0000049 | A1 * | 1/2005 | Hohlbein | 15/111 |
| 2005/0069372 | A1 | 3/2005 | Hohlbein et al. | |
| 2006/0195995 | A1 * | 9/2006 | Moskovich et al. | 15/111 |
| 2006/0272113 | A1 * | 12/2006 | Cato et al. | 15/106 |
| 2008/0052848 | A1 * | 3/2008 | Hohlbein | 15/111 |
| 2008/0174165 | A1 * | 7/2008 | Russell | 300/21 |
| 2009/0025165 | A1 * | 1/2009 | Moskovich et al. | 15/167.1 |

FOREIGN PATENT DOCUMENTS

| | | | |
|---|---|---|---|
| CN | 99225704.2 | | 11/1999 |
| DE | 857 128 | | 11/1952 |
| DE | 29 30 459 | | 2/1981 |
| DE | 31 14 507 | A1 | 3/1983 |
| DE | 36 39 424 | A1 | 6/1988 |
| DE | 9416395 | U1 | 12/1994 |
| EP | 0654232 | A | 5/1995 |
| EP | 0 875 169 | | 11/1998 |
| EP | 1 034 721 | | 9/2000 |
| EP | 1308108 | | 5/2003 |
| FR | 537979 | | 6/1922 |
| FR | 2594307 | A1 | 4/1987 |
| GB | 17643 | | 0/1912 |
| GB | 495982 | | 11/1938 |
| GB | 2371217 | | 7/2002 |
| GB | 2391462 | | 2/2004 |
| JP | 2000-278899 | | 10/2000 |
| JP | 2000-308522 | | 11/2000 |
| JP | 2001-314232 | | 11/2001 |
| JP | 2002-142687 | | 5/2002 |
| JP | 2003019029 | | 1/2003 |
| RU | 1708283 | | 1/1992 |
| TW | 490297 | | 1/2001 |
| TW | 200630074 | | 2/2006 |
| TW | 200642623 | | 5/2010 |
| WO | WO 98/05241 | A | 2/1998 |
| WO | WO 98/08458 | | 3/1998 |
| WO | WO 9809573 | | 3/1998 |
| WO | WO 99/49754 | A1 | 10/1999 |
| WO | WO 00/53034 | | 9/2000 |
| WO | WO 00/64307 | | 11/2000 |
| WO | WO 01/17433 | A1 | 3/2001 |
| WO | WO 01/45573 | A1 | 6/2001 |
| WO | WO 01/80686 | A2 | 11/2001 |
| WO | WO 02/062174 | | 8/2002 |
| WO | WO 02/071957 | A2 | 9/2002 |
| WO | WO 03/030680 | A | 4/2003 |
| WO | WO 2004/019801 | A | 3/2004 |
| WO | 2006018927 | A | 2/2006 |

OTHER PUBLICATIONS

Examiner's Report from the Canadian Intellectual Property Office, dated Mar. 15, 2011, for corresponding Canadian Patent Application No. 2,677,801.

Office Action from the Taiwan Intellectual Property Office, dated Mar. 23, 2011, for corresponding Taiwan Patent Application No. 097104529.

* cited by examiner

TOOTHBRUSH WITH LOW PROFILE HEAD

FIELD OF THE INVENTION

This invention relates generally to toothbrushes, and, in particular, to a toothbrush having tooth cleaning elements and a tissue cleanser with a low profile head.

BACKGROUND OF THE INVENTION

According to the American Dental Association, a major source of bad breath in healthy people is microbial deposits on the tongue, where a bacterial coating harbors organisms and debris that contribute to bad breath. One particular spot on the tongue that harbors significant quantities of odor-causing bacteria is the back of the tongue. The tongue is a haven for the growth of microorganisms since the papillary nature of the tongue surface creates a unique ecological site that provides an extremely large surface area, favoring the accumulation of oral bacteria. Anaerobic flora and bacteria residing on the tongue play an important role in the development of chronic bad breath commonly called halitosis. In general, the bacteria produce volatile sulfur compounds (VSC). If there is enough buildup of the sulfur compounds, the result can be lead bad breath or oral malodor. There is also evidence supporting the breath freshening benefits of cleansing cheek surfaces to remove dead skin cells, which ultimately will settle on the tongue surface becoming a source of protein for a host of odor causing bacteria.

Consequently, tissue cleansers have been added to a face of the head of a conventional toothbrush opposite the face on which the tooth cleaning elements are positioned. Adding a tissue cleanser increases the head height of the brush. Using a conventional toothbrush having tooth cleaning elements and a tissue cleanser to clean the back of the tongue often results in the gag reflex due to inadvertent contact with the back of the throat, due to the increased head height of the brush. This increase in head height also negatively affects the tooth cleaning efficacy of the brush, making brush head access to hard to reach areas, such as the buccal surfaces of the third molars, difficult due to restricted access between cheeks and teeth. Previous efforts seen in the art to improve oral access have typically focused on the "head size", as evidenced by the offering of "compact", and even "ultra-compact" head sizes. These smaller head sizes have in fact only focused on reducing the length and width of the brush head, and have ignored the overall brush head height, the primary restriction in accessing tight buccal spaces, and primary cause of the gag reflex when cleansing the back of the tongue.

It would be desirable to provide a toothbrush with tooth cleaning elements and a tissue cleanser that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide a toothbrush with tooth cleaning elements and a tissue cleanser with a reduced profile. In accordance with a first aspect, a toothbrush includes a handle, and a head at an end of the handle having a thickness, a first surface, and an opposed second surface. Tooth cleaning elements extend outwardly from the first surface and have a length. A tissue cleanser is positioned on the second surface and has a height. A head height includes the thickness of the head, the length of the tooth cleaning elements, and the height of the tissue cleanser, and is less than 17.7 mm.

In accordance with another aspect, a toothbrush includes a handle and a head at an end of the handle having a thickness of approximately 3.6 mm, a first surface, and an opposed second surface. Tooth cleaning elements extend outwardly from the first surface and have a diameter of less than 7 mil (0.007"). A tissue cleanser on the second surface has a plurality of nubs and a height of approximately 0.5 mm. A head height includes the thickness of the head, the length of the tooth cleaning elements, and the height of the tissue cleanser, and is less than 17.7 mm.

Substantial advantage is achieved by providing a toothbrush with tooth cleaning elements and a tissue cleanser with a reduced profile. In particular, certain embodiments of a toothbrush with tooth cleaning elements and a tissue cleanser with a reduced profile allow a user to more comfortably clean tissue deep in the mouth, helping to reduce the body's natural gag reflex. A further advantage is gained in tooth cleansing by providing improved access to tight buccal surfaces. A further advantage is offered in cleaning cheek surfaces opposite third molars, as the soft tissue cleanser is able to reach further into the tight pocket space between third molars and cheeks.

These and additional features and advantages disclosed here will be further understood from the following detailed disclosure of certain embodiments.

Figure 1:
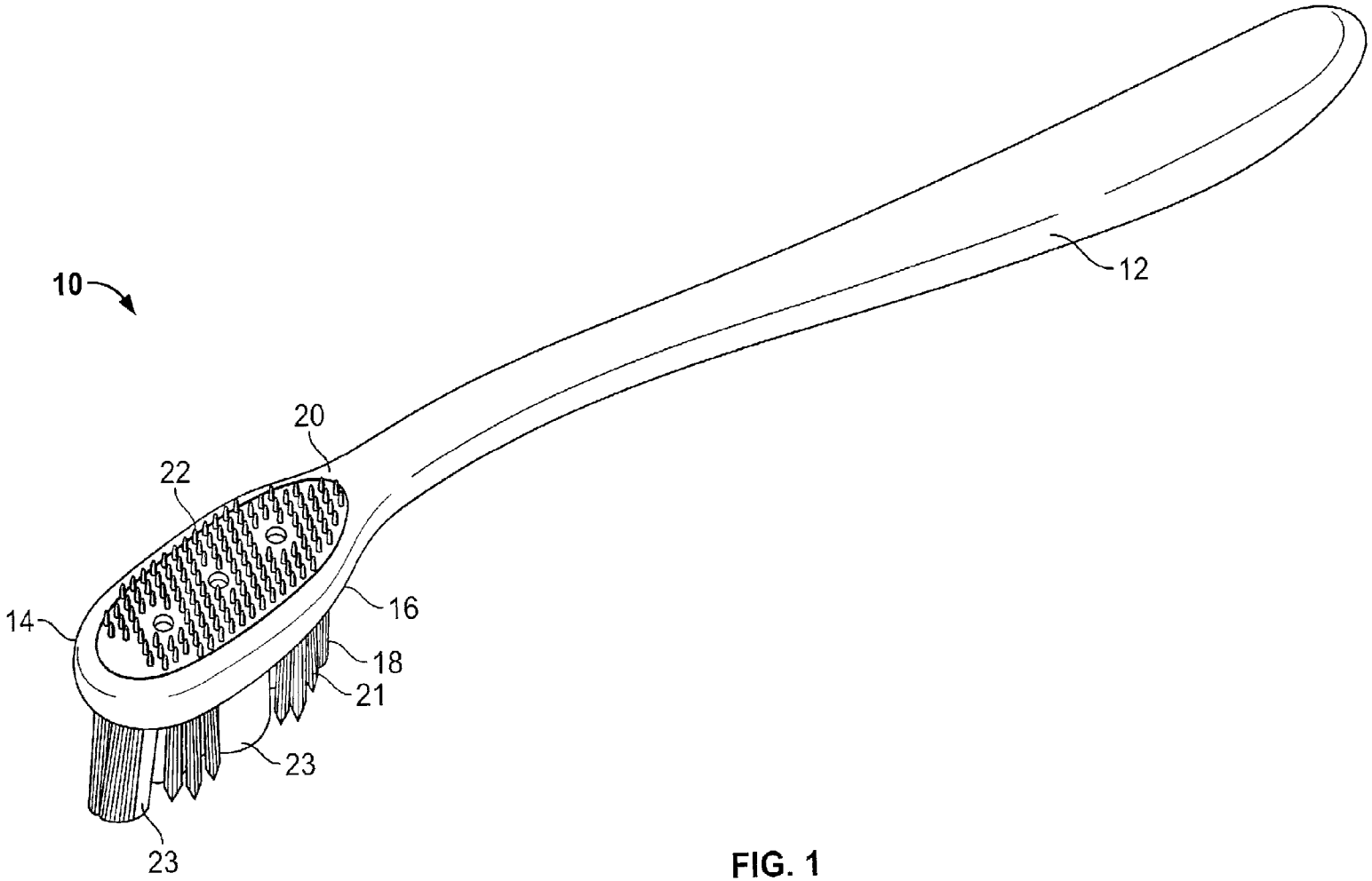
FIG. 1 is a perspective view of a toothbrush with tooth cleaning elements and tissue engaging elements.

The figures referred to above are not drawn necessarily to scale and should be understood to provide a representation of the invention, illustrative of the principles involved. Some features of the toothbrush depicted in the drawings have been enlarged or distorted relative to others to facilitate explanation and understanding. The same reference numbers are used in the drawings for similar or identical components and features shown in various alternative embodiments. Toothbrushes as disclosed herein would have configurations and components determined, in part, by the intended application and environment in which they are used.

DETAILED DESCRIPTION OF CERTAIN PREFERRED EMBODIMENTS

FIG. 1 illustrates an oral care implement, such as a toothbrush 10, having a handle 12 and a head 14, which may be used for cleaning the teeth and soft tissue in the mouth, such as the tongue, interior surfaces of the cheeks, lips or the gums. Handle 12 is provided for the user to readily grip and manipulate the toothbrush, and may be formed of many different shapes and constructions. Head 14 has a first face 16 that supports tooth cleaning elements 18 and an opposed second face 20 that supports a tissue cleanser 22.

As use herein, the term "tooth cleaning elements" includes any type of structure that is commonly used or is suitable for use in providing oral health benefits (e.g., tooth cleaning, tooth polishing, tooth whitening, massaging, stimulating, etc.) by making intimate contact with portions of the teeth and gums. Such tooth cleaning elements include, but are not limited to, tufts of bristles 21 that can be formed to have a number of different shapes and sizes, and elastomeric cleaning members 23 that can be formed to have a number of different shapes and sizes, or a combination of both tufts of bristles and elastomeric cleaning members. Bristle tufts may be arranged on first face 16 in any configuration.

The bristle tufts may be formed with bristles of the same or different bristle materials (such as nylon bristles, spiral bristles, rubber bristles, etc.). Moreover, while tooth cleaning elements 18 may be arranged so that they are generally perpendicular to first face 16, some or all of tooth cleaning elements 18 may be angled at various angles with respect to first face 16. When first face 16 includes bristle tufts, it is thereby possible to select the combination of bristles configurations, bristle materials and bristle orientations to achieve specific intended results and operational characteristics, thus maximizing and enhancing cleaning, tooth polishing, tooth whitening, massaging, and stimulation.

The bristle tufts may be arranged by any conventional method. For example, the bristle tufts may be stapled to head 14. In certain embodiments, tooth cleaning elements 18 in the form of strands or bristles can be attached via in-mold tufting (IMT) methods that generally require small cross-sections of material into which the strands are permanently attached. The strands utilizing IMT methods may be attached during formation of the handle 12 or during formation of head 14, which is the portion of toothbrush 10 to which the strands and other materials are attached.

In other embodiments, tooth cleaning elements 18 in the form of strands or bristles may be attached via anchor free tufting (AFT). In the AFT brush making process, described in detail in U.S. Pat. No. 6,779,851, nylon is fed into a pre-molded plate that can be made from any thermoplastic or elastomer material or combination thereof. This nylon may be processed into bristle tufts of various sizes and shapes. The non-use or proximal end of the nylon is heated and melted to retain the nylon in the brush head when a reasonable pulling force is applied. This head plate may then be ultrasonically welded to a pre-molded handle that has a peripheral wall or frame on which the head plate will rest and become fused to the handle.

Tissue cleanser 22 may be formed of an elastomeric material, such as a biocompatible resilient material suitable for uses in an oral hygiene apparatus. To provide improved comfort as well as cleaning benefits, the elastomeric material preferably has a hardness property in the range of A8 to A25 Shore hardness. As an example, one embodiment of an elastomeric material is styrene-ethylene/butylene-styrene block copolymer (SEBS) manufactured by GLS Corporation. It is to be appreciated that SEBS material from other manufacturers, or other materials within and outside the noted hardness range could be used. Suitable materials for tissue cleanser 22 will become readily apparent to those skilled in the art, given the benefit of this disclosure.

Figure 2:
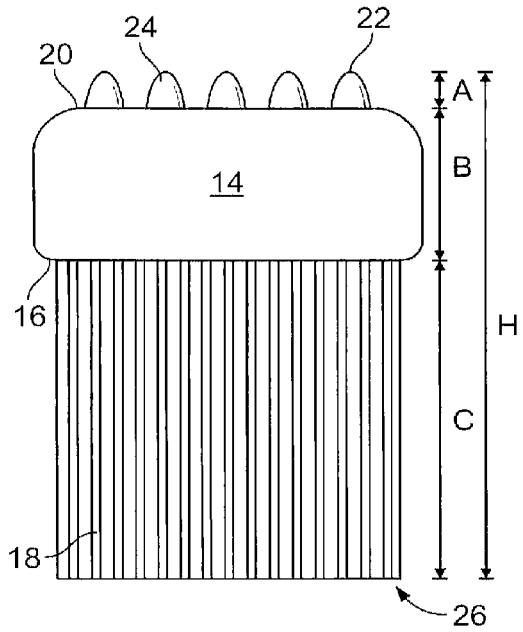
FIG. 2 (Prior Art)
FIG. 2 is an end elevation view of the head of a prior art toothbrush.
Figure 3:
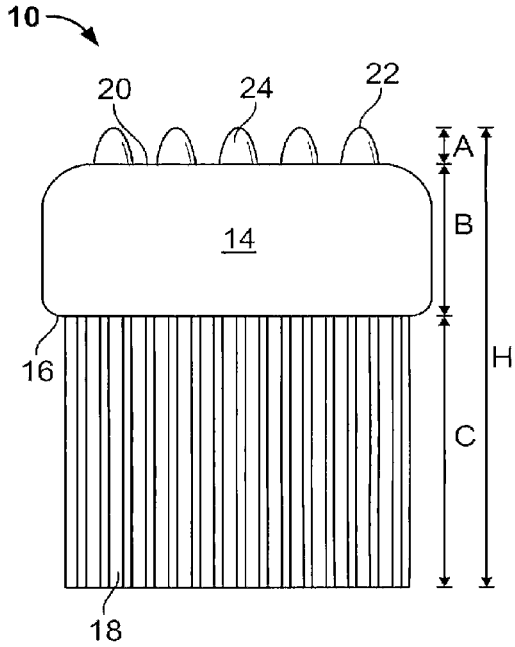
FIG. 3 is an end elevation view of the toothbrush of FIG. 1.

A prior art toothbrush 26 is seen in FIG. 2. Tooth cleanser 22 of toothbrush 26 has a height A, measured from second surface 20. Head 14 of toothbrush 26 has a thickness B, and tooth cleaning elements 18 of toothbrush 26 have a length C. Thus, it can be seen that the total head height H of toothbrush 14 is the combination of height A of tooth cleanser 22, the thickness B of head 14, and the length C of tooth cleaning elements 18. Known prior art toothbrushes with tooth cleaning elements 18 and a tooth cleanser 22 have a head height H of approximately 19 mm.

In certain embodiments, as seen in FIG. 2, the profile or head height H of toothbrush 10 can be reduced by reducing length C of bristles 18. Length C of bristles 18 is driven by a number of factors, including mouth feel, cleaning ability, bristle durability, the type of material in which the bristles are secured, and manufacturing equipment limitations. As a general rule, the shorter the length of a toothbrush bristle, the thinner the fiber needed to maintain the appropriate brush stiffness. The most common method to date of manufacturing toothbrushes has been with staple technology. With this process, there are practical limits on how small a diameter fiber one can use, with approximately 0.006 mil being the typical smallest fiber one can efficiently run. Nearer processes for manufacturing toothbrushes offer the potential to reduce the limitations of conventional staple tufting. For example, IMT and AFT may be used, which allow bristles of a shorter length. AFT utilizes pre-end rounded bristles, which can allow end rounding of thinner bristles than conventional end rounding.

In certain embodiments, length C of bristles 18 can be produced, via IMT or AFT, for example, having a length significantly less than 13 mm.

Figure 4:
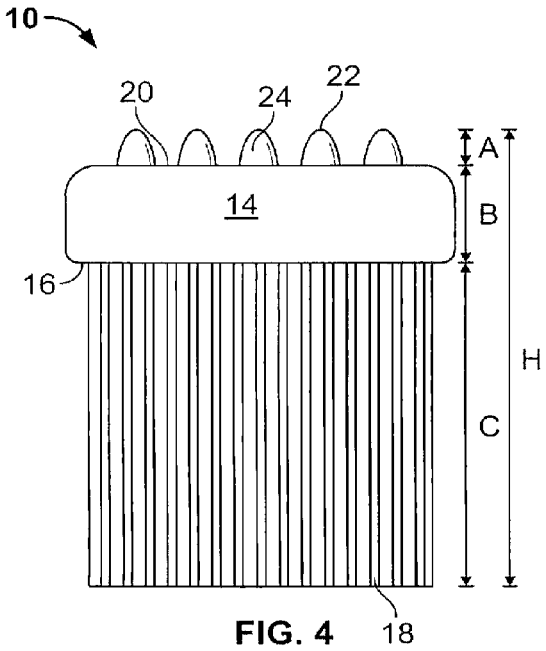
FIG. 4 is an end elevation view of an alternative embodiment of a toothbrush with tooth cleaning elements and tissue engaging elements.

In other embodiments, as seen in FIG. 4, the head height H of toothbrush 10 can be reduced by reducing the thickness B of head 14. Thickness B of head 14 is typically driven by the structure required to adequately hold bristles 18 in head 14. In the case of staple technology, thickness B of head 14 typically runs between approximately 5.1 mm and approximately 6.2 mm. Using IMT and/or AFT brush making technologies, which anchor bristles 18 in head 14 without metal staples, offer the ability to significantly reduce thickness B of head 14. In certain embodiments, using IMT and/or AFT technologies, it has been found that adequate head strength can be maintained with thickness B of head 14 as small as approximately 3.6 mm.

Tissue cleanser 22 may include a plurality of tissue engaging elements 24, which in certain embodiments are formed as nubs. As used herein a "nub" is generally meant to include a column-like protrusion (without limitation to the cross-sectional shape of the protrusion) that is upstanding from a base surface. In a general sense, the nub in such embodiments has a height that is greater than the width at the base of the nub. Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height. Various embodiments of nubs 24 are described in commonly owned U.S. Pat. No. 7,143,462, entitled "Oral Care Implement," the entire disclosure of which is hereby incorporated by reference in its entirety.

Such tissue engaging elements or nubs 24 are designed to significantly reduce a major source of bad breath in people and improve hygiene. Nubs 24 enable removal of microflora and other debris from the tongue and other soft tissue surfaces within the mouth. The tongue, in particular, is prone to develop bacterial coatings that are known to harbor organisms and debris that can contribute to bad breath. This microflora can be found in the recesses between the papillae on most of the tongue's upper surface as well as along other soft tissue surfaces in the mouth. When engaged or otherwise pulled against a tongue surface, for example, nubs 24 provide for gentle engagement with the soft tissue while reaching downward into the recesses of adjacent papillae of the tongue. The elastomeric construction of nubs 24 also enables them to follow the natural contours of the oral tissue surfaces, such as the tongue, cheeks, lips, and gums of a user. Moreover, the soft nubs 24 are able to flex as needed to traverse and clean the soft tissue surfaces in the mouth along which they are moved.

Figure 5:
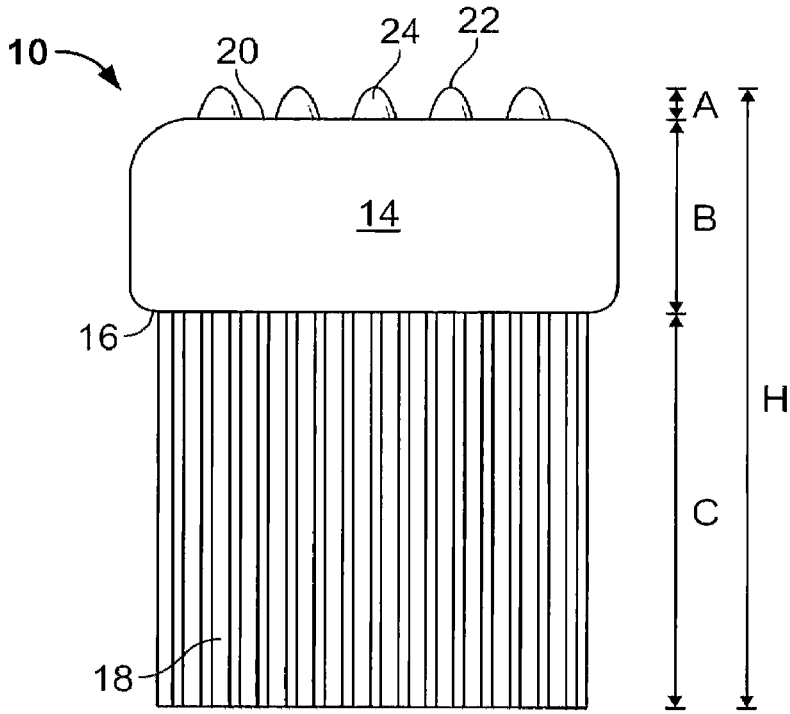
FIG. 5 is an end elevation view of another alternative embodiment of a toothbrush with tooth cleaning elements and tissue engaging elements.
Figure 6:
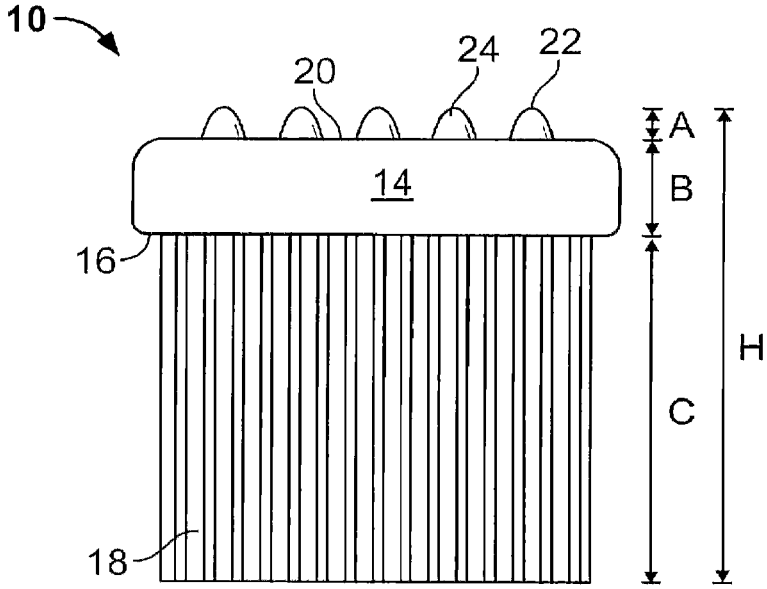
FIG. 6 is an end elevation view of a further alternative embodiment of a toothbrush with tooth cleaning elements and tissue engaging elements.

In certain embodiments, as illustrated in FIG. 5, height A of tissue cleanser 22 can be reduced through the use of nubs 24. The thickness or width of the base of nubs 24 may range from about 0.51 mm to about 2.00 mm. Height A of nubs 24, as measured from second surface 20 to the tip of nubs 24 may be between approximately 0.5 mm and approximately 2.5 mm.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

The invention claimed is:

1. A toothbrush comprising:

a handle;

a head at an end of the handle and having a thickness, a first surface, an opposed second surface and a peripheral frame;

a head plate welded to the peripheral frame;

tooth cleaning elements extending outwardly from the head plate and having a length, the tooth cleaning elements being AFT mounted to the head plate; and a tissue cleanser having a height, the tissue cleanser formed of an elastomeric material and comprising a base in the second surface and a plurality of tissue engaging elements extending outwardly from the base;

wherein a head height comprising the thickness of the head, the length of the tooth cleaning elements, and the height of the tissue cleanser is less than 17.7 mm.

2. The toothbrush of claim 1, wherein the thickness of the head is between approximately 3.6 mm and approximately 6.2 mm.

3. The toothbrush of claim 1, wherein the thickness of the head is approximately 3.6 mm.

4. The toothbrush of claim 1, wherein the tooth cleaning elements have a diameter of less than 7 mil.

5. The toothbrush of claim 1, wherein the height of the tissue cleanser is approximately 0.5 mm.

6. The toothbrush of claim 1, wherein the height of the tissue cleanser is between approximately 0.5 mm and approximately 2.5 mm.

7. The toothbrush of claim 1, wherein the tissue engaging elements are nubs.

8. The toothbrush of claim 1, wherein the tooth cleaning elements are bristles.

9. The toothbrush of claim 1, wherein the height of the tissue cleanser is approximately 0.5 mm, and the tooth cleaning elements have a diameter of less than 7 mil.

10. A toothbrush comprising:

a handle;

a head at an end of the handle and having a thickness of approximately 3.6 mm, a first surface, an opposed second surface, and a peripheral frame;

a head plate welded to the peripheral frame;

tooth cleaning elements extending outwardly from the head plate and having a diameter of less than 7 mil, the tooth cleaning elements being AFT mounted to the head plate; and a tissue cleanser comprising a base in the second surface and a plurality of nubs formed of an elastomeric material extending outwardly from the base and having a height of approximately 0.5 mm;

wherein a head height comprising the thickness of the head, the length of the tooth cleaning elements, and the height of the tissue cleanser is less than 17.7 mm.

* * * * *